United States Patent [19]

Edwards

[11] 3,967,466

[45] July 6, 1976

[54] AIR CONDITIONING SYSTEM HAVING SUPER-SATURATION FOR REDUCED DRIVING REQUIREMENT

[75] Inventor: Thomas C. Edwards, Casselberry, Fla.

[73] Assignee: The Rovac Corporation, Maitland, Fla.

[22] Filed: Mar. 17, 1975

[21] Appl. No.: 559,063

Related U.S. Application Data

[63] Continuation-in-part of Ser. No. 465,841, May 1, 1974, Pat. No. 3,913,351.

[52] U.S. Cl. ..... 62/402; 62/87; 62/91; 62/121; 62/304

[51] Int. Cl.[2] ..... F25D 9/00

[58] Field of Search ..... 62/317, 93, 272, 275, 62/402, 91, 86, 172

[56] References Cited

UNITED STATES PATENTS

| | | | |
|---|---|---|---|
| 2,175,163 | 10/1939 | Waterfill | 62/91 |
| 2,197,492 | 4/1940 | Dodge | 62/402 |
| 2,304,151 | 12/1942 | Crawford | 62/86 |
| 2,585,570 | 2/1952 | Messinger et al. | 62/402 |
| 2,704,925 | 3/1955 | Wood | 62/172 |
| 2,834,188 | 5/1958 | Bradford | 62/402 |
| 3,686,893 | 8/1972 | Edwards | 62/402 |

*Primary Examiner*—Lloyd L. King
*Attorney, Agent, or Firm*—Leydig, Voit, Osann, Mayer & Holt, Ltd.

[57] ABSTRACT

An air conditioning unit having a driven rotor with a plurality of vanes and including a compressor portion and an expander portion, each having inlet and outlet ports, with a heat exchanger connected between the compressor outlet port and the expander inlet port. A non-condensing gas such as air is fed into the compressor inlet port, compressed, accompanied by a rise in temperature, cooled by the heat exchanger, and expanded back to substantially its initial pressure for discharge in the cold state at the expander outlet port, a non-condensing gas being defined as any gas which does not condense at the pressures and temperatures encountered in the unit. In accordance with the main feature of the present invention, means are provided for spraying into the non-condensing gas at the compressor inlet port an excess of finely divided droplets of a condensible additive fluid, having a high heat of vaporization, to super-saturate the gas, the droplets evaporating due to the temperature achieved in compression thereby absorbing heat of vaporization. This results in a reduction in temperature of the gas at the compressor outlet port thereby reducing the work required to compress the gas and consequently the work required to drive the rotor. As the compressed gas is cooled in the heat exchanger, the excess additive fluid condenses, is collected in a sump, and recirculated back to the compressor inlet port. The gas leaving the heat exchanger, still saturated with fluid, is cooled in the expander resulting in further condensation in the expander releasing heat of vaporization and increasing the work of expansion further reducing the network required to drive the rotor. In one embodiment of the invention the system is open and air is used as gas, with water as the additive. In such embodiment the cold air is discharged into the cooled space via an outlet assembly which serves as a second heat exchanger. In a second embodiment a second heat exchanger provides a closed connection between the expander outlet port and the condenser inlet port to form a loop sealed against escape of gas. When the system is closed, the gas and additive fluid may take forms other than water and may include a lubricant for the vanes of the rotor.

30 Claims, 11 Drawing Figures

DRIVE
DRAIN

54'
60'
55'
M
53'
SOURCE OF WATER
ALTERNATE
100'
62'
ALTERNATE
P
10'
44'
41'
11'
92'
DIRECT DISCHARGE
32'
33'
DRIVE
42'
43'
80'
130
131
87'
86'

143
142
145
140
144
141
150
WATER RESERVOIR
148
41b
10b
146
147
92b
44b
70 COOLED SPACE

11"
41"
92"
10"
134"
44"
42b
43b
32"
45b
91"
42"
43"
133
93"
135
80"
86"
87"

AIR CONDITIONING SYSTEM HAVING SUPER-SATURATION FOR REDUCED DRIVING REQUIREMENT

This application is a continuation-in-part of prior application Ser. No. 465,841 which was filed May 1, 1974 now U.S. Pat. No. 3,913,351.

That application was primarily directed toward means for intentionally saturating the gas, usually air, which is fed to the inlet port of a compressor-expander with a condensible additive fluid, generally water, in order to produce intentional condensation of the fluid in the expander thereby to release the heat of vaporization of the fluid, to increase the work of expansion, and thus to reduce the net work required to drive the rotor. Where the fluid entering the compressor inlet is substantially saturated (as contrasted with super-saturation), no gross change of state of the additive fluid occurs in the compressor so that the driving requirement of the compressor remains unchanged. However, it was disclosed in the prior application that the driving requirement of the compressor could be substantially reduced, and the coefficient of performance of the unit further improved, by spraying into the gas entering the compressor inlet port an excess of finely divided droplets of condensible fluid for super-saturation of the gas and with the particles undergoing a gross change of state, from droplet to vapor form, as a result of the temperature achieved in compression, thereby reducing the work required to compress the gas. It is the purpose of the present application to disclose and claim an air conditioning system which includes the spraying into the gas at the compressor inlet port an excess of finely divided droplets to achieve gross super-saturation of the inlet air to achieve the advantages thereof, with means for disposing of, and utilizing, the resulting condensation of additive fluid occurring in the heat exchanger.

It is, accordingly, an object of the present invention to provide an air conditioning system employing a compressor-expander having means for spraying into the gas at the compressor inlet port an excess of finely divided droplets of an additive fluid thereby to super-saturate the gas, with the droplets being evaporated during compression, and with a sump being provided in the heat exchanger for collection of the subsequently condensed fluid. It is a more specific object to provide means for utilizing the condensate in the sump by providing a feedback line for recirculating the fluid to the compressor inlet port where it is again sprayed into the entering gas, utilizing the pressure differential which exists between the heat exchanger and the compressor inlet port to move the fluid.

It is a related object of the present invention to provide an air conditioning unit utilizing a compressor-expander in which an excess of finely divided droplets are sprayed into the gas entering the compressor inlet port and which utilizes the change of state of the fluid occurring in both the compression and expansion sides of the device to substantially reduce the driving requirement of the rotor to bring about a marked increase in the coefficient of performance of the system. More specifically it is an object to provide a compressor-expander in which an excess of finely divided droplets of additive fluid are sprayed into the gas entering the compressor inlet port, grossly super-saturating the gas resulting in large scale evaporation during compression, with removal of the excess fluid by collection and condensation in the heat exchanger, and followed by condensation of fluid in the expander. The evaporation in the compressor and the condensation in the expander both serve to reduce the rotor driving requirement, while the condensation of fluid in the heat exchanger substantially improves the rate of heat exchange making it possible to use a heat exchanger of limited size.

It is another object of the present invention to provide a heat exchanger having a sump for collection of condensed fluid and with automatic means for insuring that fluid always exists in the feedback line. It is a related object of the invention to provide a system employing a heat exchanger having a sump with automatic means for maintaining an optimum fluid level. It is a further and related object to provide a system employing a heat exchanger and sump having provision for injecting make-up fluid into the sump as the need for make-up fluid may arise.

It is a general object of the present invention to provide an air conditioning system in which the air operates as its own refrigerating medium, with discharge of the cooled air into an enclosed space, in which an excess of water is intentionally sprayed into the air entering the unit to improve the efficiency of the system but with the water, having accomplished its purpose, being effectively removed at a low temperature for discharge of dry air into the enclosed chamber.

It is yet another object of the present invention to provide an air conditioning system which can be constructed at a cost which is substantially less than conventional air conditioning systems but which nevertheless has a substantially higher coefficient of performance than conventional systems, which has a high cooling capacity, which operates automatically, and which is highly compact, thereby making the system particularly well suited for use in automobiles and the like.

Other objects and advantages of the invention will become apparent upon reading the attached detailed description and upon reference to the drawings in which:

FIG. 1 is a diagram showing in cross section, with a portion taken along the line 1—1 in FIG. 1*a*, an air conditioning system employing the present invention and which is of the "open" type employing air as the refrigerated gas and water as the additive fluid and with means for dehumidifying and tempering the air which is discharged into the enclosed space;

FIG. 1*a* is a horizontal fragmentary section taken along the line 1*a*—1*a* in FIG. 1;

FIG. 2 is a cross section taken through the filter along the line 2—2 in FIG. 1;

FIG.. 3 is a fragmentary diagram showing simplified means for insuring maintenance of liquid in the feedback line and means for automatic control of maximum level of condensed liquid in the sump;

Figure 5:
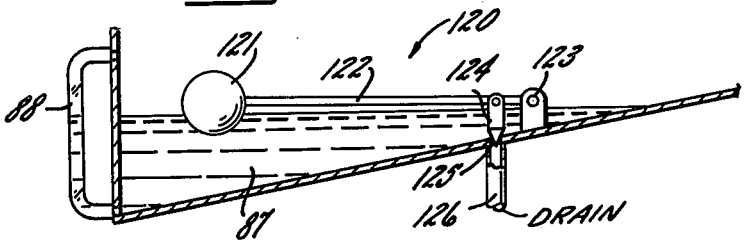
FIG. 5 is a fragmentary section showing disposition of condensed liquid in the sump by overflow usable with the structure of FIG. 4.
Figure 5A:
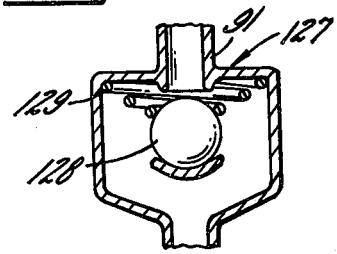

FIG. 5*a* shows a cutoff device for use in the feedback line.

Figure 1:
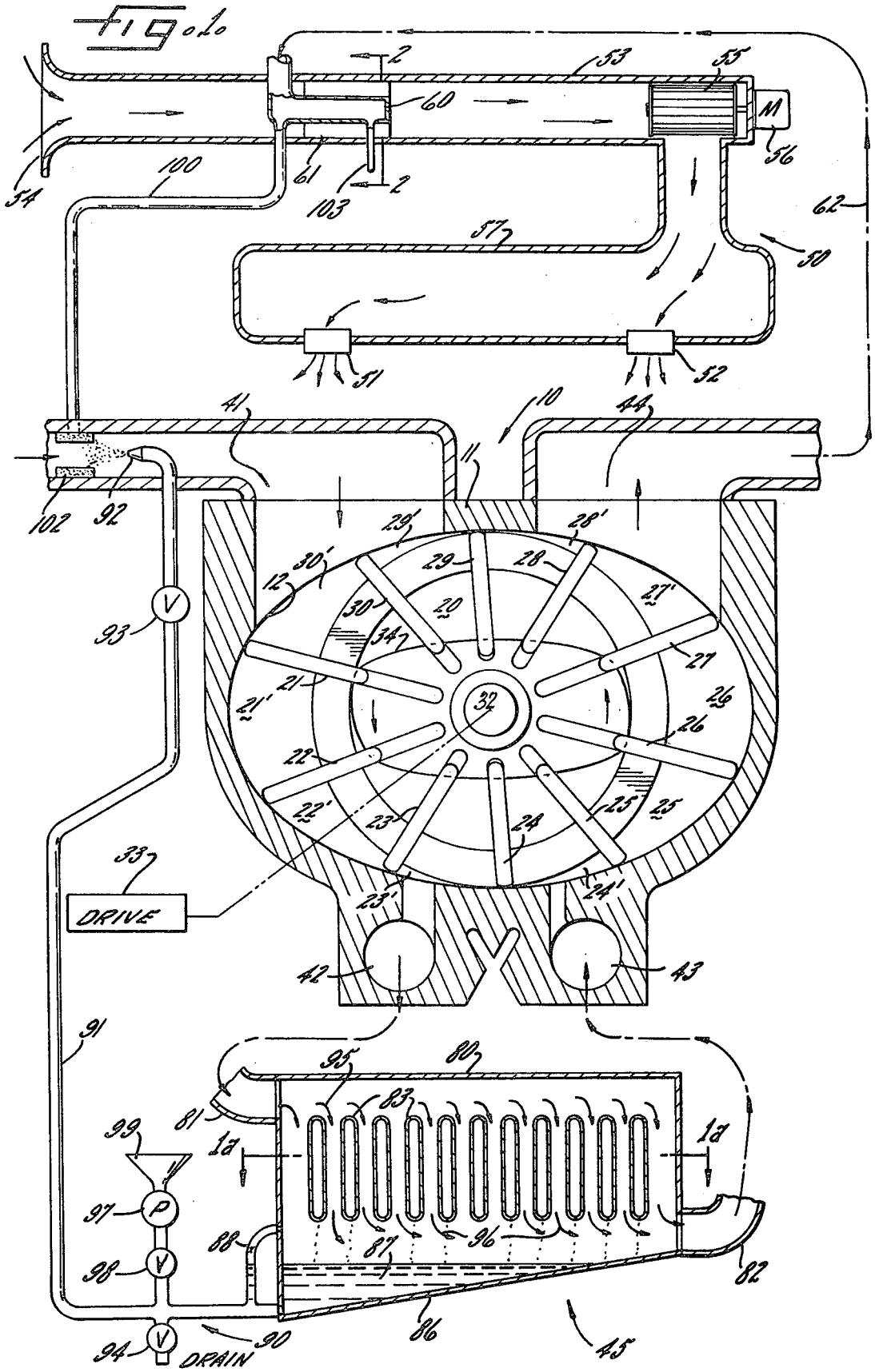
Figure 6:
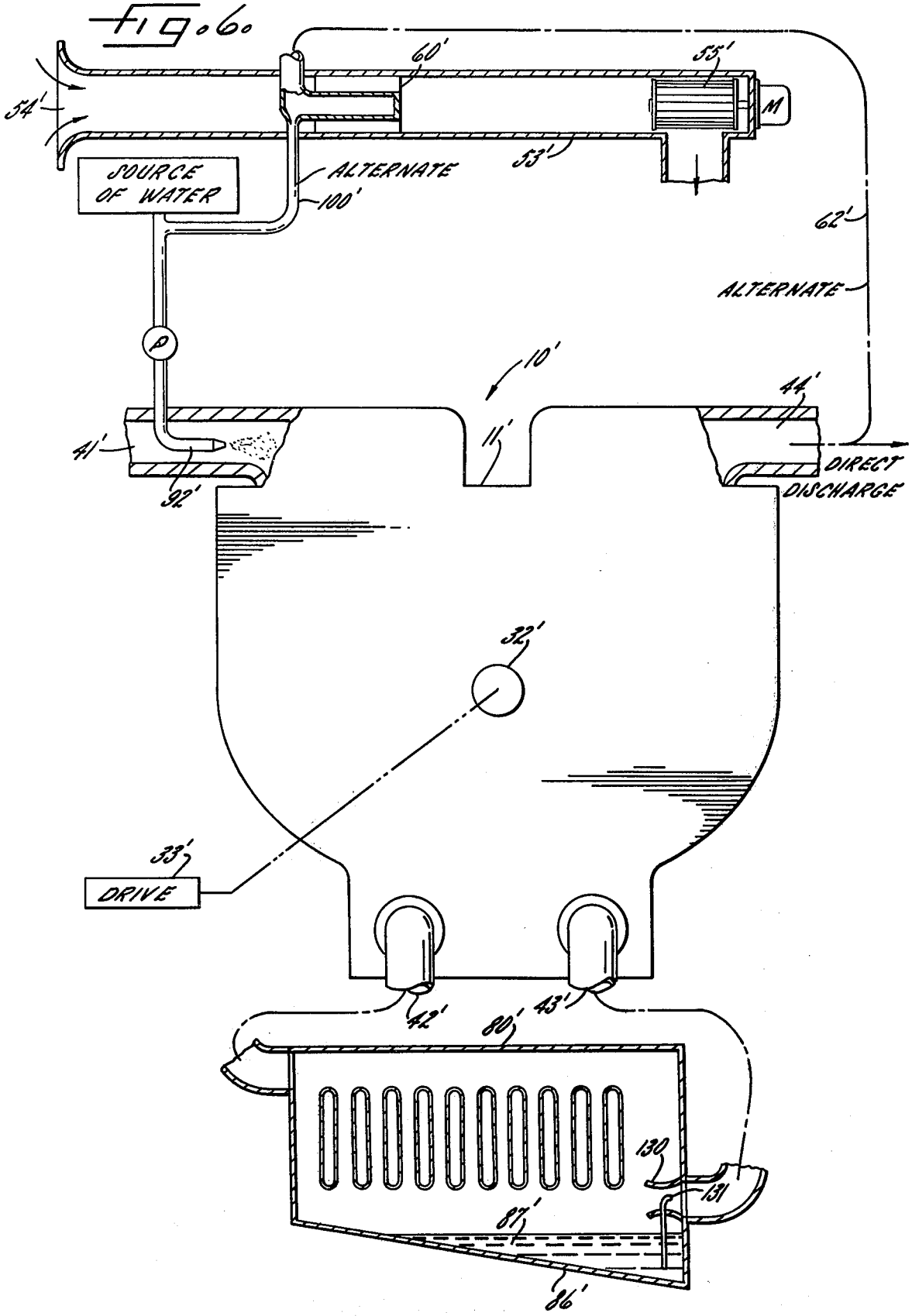
Figures 7, 9:
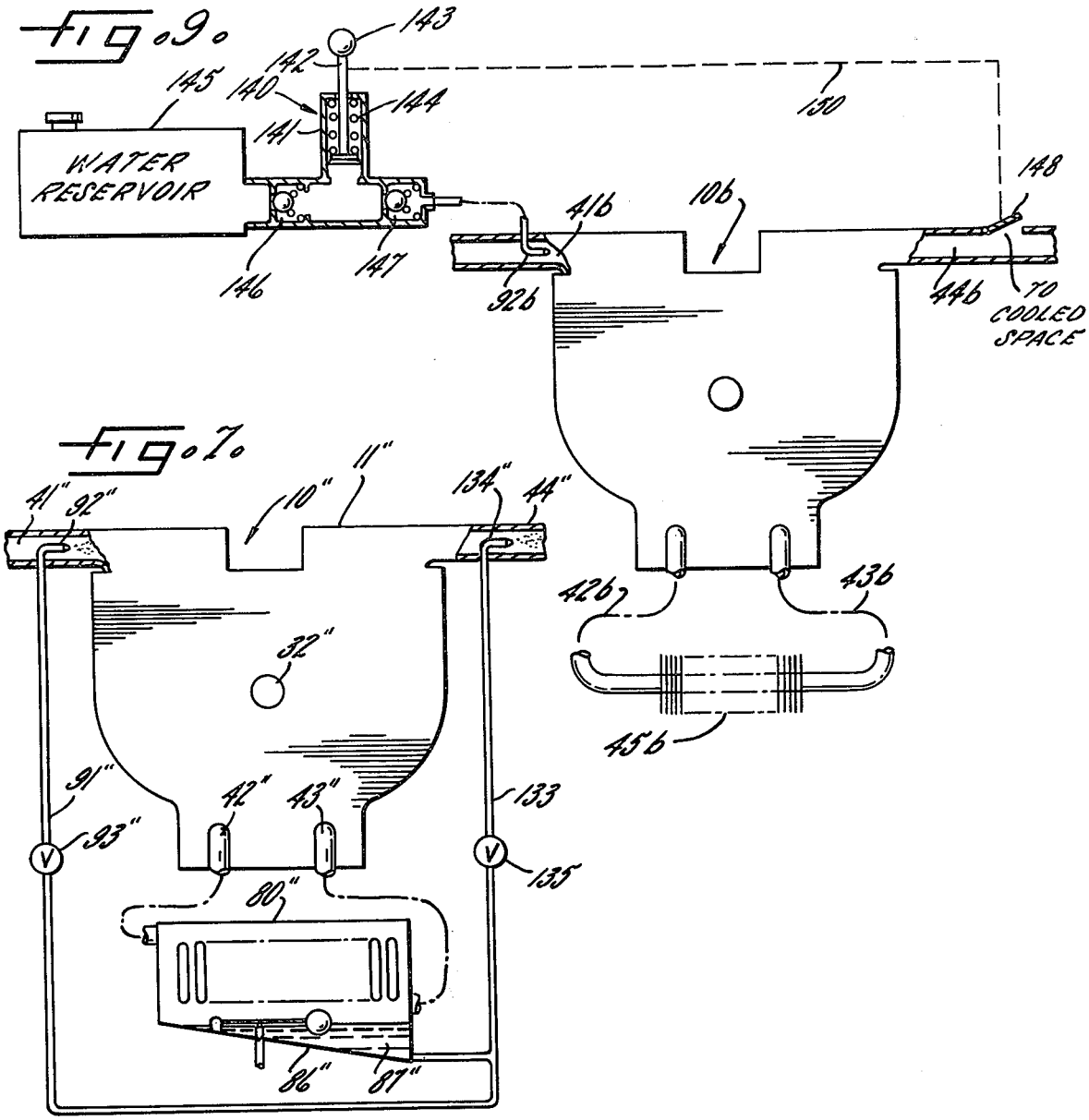
Figure 8:
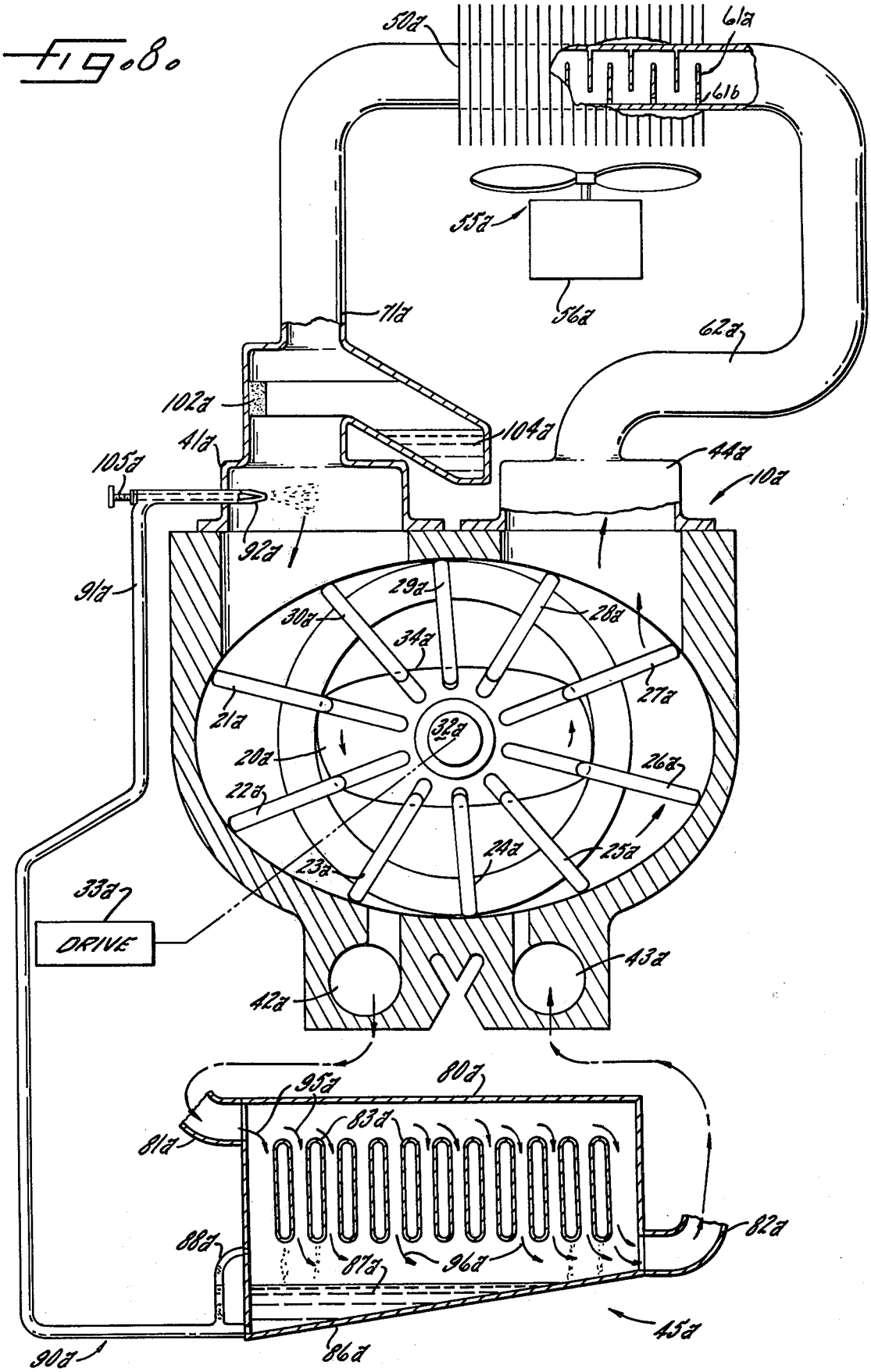

FIG. 6 is a diagram similar to FIG. 1 but showing a simplified system in which condensed moisture is removed from the heat exchanger by aspiration through the expander;

FIG. 7 shows spraying of water into the outlet port;

FIG. 8 is a further diagram showing, in cross section, the invention applied to a closed refrigeration system in which a gas, excessive additive fluid, and lubricant are sealed from the atmosphere and continuously recirculated; and, FIG. 9 is a diagram showing means for injecting a "shot" of water for urgent cooling and humidification.

While the invention has been described in connection with certain preferred embodiments, it will be understood that I do not intend to be limited to the particular embodiments shown but intend, on the contrary, to cover the various alternative and equivalent forms of the invention included within the spirit and scope of the appended claims.

Turning now to FIG. 1, there is disclosed a compressor-expander 10 having a frame 11 having formed therein a chamber of oval cross section defined by a wall 12. It will be understood that the chamber is enclosed, at its ends, with parallel end members (not shown) as described in my prior application Ser. No. 400,965 filed Sept. 26, 1973. Journaled in the end members is a rotor 20 having radially extending slidable vanes which may, for example, be 10 in number and which have been designated 21–30 inclusive. The rotor has a shaft 32 which is journaled in bearings mounted in the respective end members, the shaft being connected to a source of driving power 33, typically an automobile engine, operating at a speed which may range between 650 and 4000 rpm. The vanes are all pressed outwardly, in their respective slots, by centrifugal force to form enclosed compartments 21′–30′, respectively, which undergo changes in volume as the rotor rotates. The vanes may be guided by rollers rolling in a cam track as shown in my application Ser. No. 400,965 filed Sept. 26, 1973, now U.S. Pat. No. 3,904,327, and additional bias may be provided by an endless spring band 34 which engages the inner edges of each of them.

Assuming that the rotor turns in the direction shown by the arrows, the left half of the device acts as a compressor having an inlet port 41 and an outlet port 42, while the right-hand side acts as an expander having an inlet port 43 and an outlet port 44. Connected between the compressor outlet port 42 and the expander inlet port 43 is a first heat exchanger 45 which is provided to dissipate the heat of compression. Such heat exchanger is isolated from the compartment to be cooled. The effectiveness of the heat exchange is improved by using a motor-driven fan 46 (FIG. 1*a*).

Coupled to the expander outlet port 44 for receiving the cold air from the unit 10 is an outlet assembly 50 which performs a number of different functions, serving, primarily, as a heat exchanging device to subtract heat from the ambient air prior to discharge into the controlled space while tempering the discharged air. In the present embodiment of the invention this is accomplished by mixing the ambient air with the air from the expander, the mixed air being discharged through vents 51, 52. To do this the outlet assembly has a mixing chamber 53 having an open or inlet end 54 and a fan or blower 55 of the squirrel cage type driven by a motor 56. Air from the blower passes through a connecting conduit into a plenum 57 for discharge through the vents 51, 52.

Figure 2:
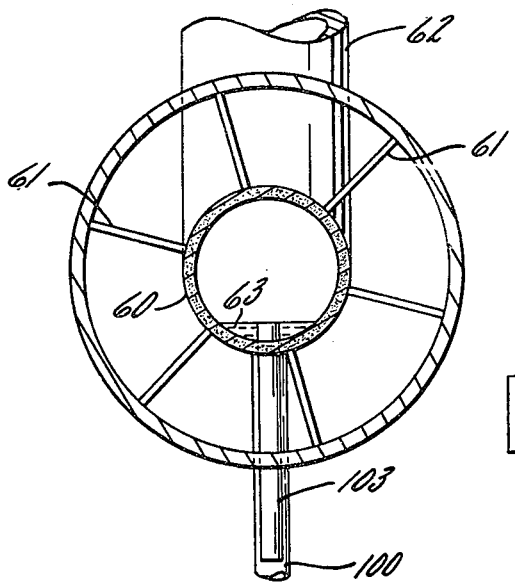

Interposed in the path of cold air from the expander into the mixing chamber is a porous moisture separator 60 which may, for example, be formed of sintered metal having a multiplicity of pores through which the cold air can flow while, nonetheless, retaining particles of ice or liquid moisture entrained in the cold air. As set forth in greater detail in my copending application Ser. No. 420,712 filed Nov. 30, 1973 now U.S. Pat. No. 3,877,245 the porous element 60 is thermally coupled to the warmer, incoming ambient air by means of longitudinally extending fins 61 (FIG. 2). The cold air is fed from the expander to the left-hand end of the element 60 via an air line 62, the right-hand end of the element being enclosed. Assuming the air line 62 is insulated, or of short physical length, preferably both, and assuming that the cold air discharged from the expander is below freezing, ice particles will be entrained in the air which is discharged into the element 60, but because of the constant warming of the element 60 by the incoming ambient air, the ice particles are melted and form condensate which runs to the bottom of the element as shown at 63.

In accordance with the present invention means are provided for injecting into the air which enters the compressor inlet port an excess of water, in finely divided droplet form, which is entrained in, and transported by the air stream. By "excess" is meant that the total amount of water in the air exceeds that which can be held in vapor form at the existing temperature which may for example, be on the order of 80°F.; indeed, the water contained per unit of air, may be up to two or more times the amount of water which can be held by the air in vapor form at such temperature. The loading of the inlet air with more moisture than it could hold if fully dissolved is referred to herein as super-saturation.

With the rotor driven by the drive, the inlet air with its entrained water in droplet form is compressed, such compression being accompanied by an increase in temperature, referred to herein as the "heat of compression", the increase in temperature resulting in a drop in relative humidity so that the particles are evaporated, that is, dissolved in the air in vapor form. In this evaporation process the air becomes saturated at the maximum temperature existing in the compressor, with the smaller droplets passing entirely into vapor form and the larger droplets being at least partially consumed. As a result of the change of state of a relatively large quantity of water, substantial amounts of heat, in the form of the heat of vaporization of the water, is subtracted from the air so that the air, while volumetrically compressed, for example, in a ratio of 2 to 4:1, is at a pressure and temperature lower than that which it would normally obtain. Thus the heating is partially counteracted, the temperature rising in a practical case to only 260°F. instead of 310°F., with the pressure being similarly reduced. As a result, because of the change of state of the added water, the amount of work required to be done per unit of air in reducing its volume is markedly less, a reduction on the order of 15% being readily achievable. The rate of injection of the water, using droplets of practical size, is preferably adjusted to achieve maximum conversion to vapor form while minimizing, or holding to reasonable level, the amount of water passing from the compressor in the undissolved, or droplet, state. In a practical case the nozzle 92 may be adjusted to the point where a minor portion of the injected water is received in the heat exchanger in droplet form.

In accordance with one of the aspects of the present invention the heat exchanger, indicated at 45, has a sump for collecting the water which is condensed as a result of cooling the compressed air, the sump having provision for feedback, preferably in the form of a return line terminating in a spray nozzle in the compressor inlet port, with the collected condensate being recirculated to the inlet of the compressor.

Thus referring to the heat exchanger 45 shown in FIG. 1, it has a housing 80 having an inlet conduit 81 and an outlet conduit 82. The heat exchanger, while sealed, is preferably perforated by a series of transversely extending tubes 83 defining air passages for increasing the active heat exchange area. For the purpose of directing the air through the tubes 83, a shroud 84 is provided forming a plenum space 85 (FIG. 1*a*) into which cooling air is propelled by the motor driven fan 46.

At the bottom of the heat exchanger housing 80 is a sump 86 for collecting a body of condensate 87. A sight glass 88 may be provided for indicating constantly the level of the condensate in the sump.

For the purpose of disposing of, and utilizing, the condensate, a drain assembly 90 is provided which includes a return line 91 terminating in a spray nozzle 92, located in the inlet port 41, which sprays a cloud of droplets 93.

It is one of the features of the heat exchanger construction that, in addition to condensing the moisture which is dissolved in the compressed air, and which condenses out as the compressed air is cooled, the heat exchanger also acts as a trap to intercept the undissolved droplets of moisture which may still exist in the air stream. Such trapping action occurs in the present construction by causing the compressed air to undergo a sudden change in direction as indicated at 95 and 96.

In operation, then, the moisture, in excessive amount, sprayed into the air stream by the nozzle 92 in the form of droplets 93 is largely evaporated during the compression cycle, with the air being discharged from the compressor outlet port 42 in the compressed state at a temperature which is less than that which would obtain absent the evaporation process. Such compressed air, flowing through the heat exchanger 45, suffers a drop in temperature back to near the ambient level, accompanied by the condensation of dissolved vapor and collection of the entrained droplets on the inside surfaces of the heat exchanger. Because of the change of state, from vapor to liquid, substantial amounts of heat are liberated by the water directly on the surfaces of the heat exchanger so that the heat exchange process is substantially more efficient than it would be in the absence of water. Even the water droplets entering the heat exchanger still in droplet form, and which are trapped on the surfaces of the heat exchanger, liberate their sensible heat, and these, in combination with the condensed water, drip down into the sump 86.

The collected water 87, being subject to the action of the compressed air above it, is under great pressure as compared to the pressure existing at the compressor inlet port 41, a pressure typically on the order of 30 lbs. per sq. in. As a result, the water which is forced through the return line 91 is applied to the nozzle 92 via valve 93 at a sufficiently high pressure so that a relatively fine discharge orifice may be used in the nozzle 92, capable of breaking the stream of water up into droplets which are so finely divided as to present a large total area available for prompt evaporation during the compression step.

Means are provided for draining off a portion of the water in the sump in the event that it rises to too high a level. Such build-up may occur where the inlet, or ambient, air is furnished with water from an auxiliary source, as will be described. Such drainage is accomplished by the opening of a drain valve 94. Conversely, especially when operating in ambient conditions of low relative humidity, a net loss of water may be experienced in the sump requiring that make-up water be added from time to time. Such water may be added via a make-up valve 98, fed from a water inlet 99. Where it is desired to add make-up water with the system pressurized, a pump 97 may be interposed.

While the compressed air leaving the heat exchanger via its outlet conduit 82 and entering the expander inlet port 43 has suffered a loss of moisture by condensation and by trapping of droplets, such air is by no means dry but on the contrary is fully saturated with moisture vapor and beings the expansion process in saturated form. Indeed, degree of saturation exceeds that achievable where the inlet air receives its water by evaporation from a porous element as taught in my prior application. In short, grossly super-saturating the air at the input not only decreases the work of compression but increases the work regained in expansion.

The saturated air progressively expands as it passes upwardly to the expander outlet port 44, and in expanding accomplishes two functions. It not only brings about a sharp drop in the temperature of the air for refrigeration purposes but the work of expansion, accompanied by a drop in pressure, tends to urge the rotor in the counterclockwise direction, thus assisting the driving means 33, as covered in the prior application.

Because of the drop in temperature and pressure, the moisture in the air is condensed in the form of entrained ice particles or droplets. The mixture of the cold air and entrained moisture passes into the porous separator 60 where the air passes through and where the particles of ice, deposited upon the porous inner walls, are constantly melted by the heat of the incoming ambient air, thereby keeping the pores of the separator open. The mixture of cold dry air and the incoming ambient air, passing through the plenum 57, is discharged in a comfortable, tempered state through the discharge vents 51, 52 into the controlled space.

The moisture of saturation, by reason of its condensation on the expander side, tends to raise the temperature and pressure of the expanding air to a level above that which would obtain if the moisture were absent. In other words the cooling and drop in pressure of the expanding air are partially counteracted. It is quantitatively shown in the copending application that this counteracting increase in temperature substantially increases the work of expansion done upon the vanes, thereby further reducing the power requirement of the drive 33 to provide a net increase in the coefficient of performance. Moreover, the presence of the added moisture, in the form of ice on the expansion side, increases the heat capacity of the air-water mix which passes through the unit at each revolution by making greater use of the latent heat of the ice particles in addition to the sensible heat of the water particles, thereby to achieve a greater cooling effect per revolution.

The moisture injected by the nozzle 92 is thus seen to have at least four significant effects: In the first place the evaporation in the compressor reduces the work of compression. Secondly, the condensation and presence of moisture in the heat exchanger greatly increases the heat exchange. Thirdly, condensation in the expander increases the work recovered in the expander. Finally, the latent heat, that is, heat of fusion, of the ice particles, and sensible heat of any residual water droplets, is utilized for refrigeration effect. The result of these effects, in combination, is to bring about a substantial improvement in the coefficient of performance of the system, that is, the ratio between the cooling capacity in B.T.U., per rotative cycle to the work which is done by the external driving means during such cycle. By saturating the inlet air, a coefficient of performance may be achieved on the order of two or three. By spraying in an excess of water droplets to grossly super-saturate the inlet air, in accordance with the present invention, the coefficient of performance may be raised to the level of 3 to 4. By comparison, in a conventional freon system it is generally considered satisfactory to achieve a coefficient of performance on the order of 1.5 to 2.

It is one of the further features of the present invention that, in addition to injecting water recirculated from the sump of the heat exchanger, the water resulting from the melting ice in the filter 60 may also be recirculated back to the incoming air stream. This is accomplished by a second feedback line 100 (see both FIGS. 1 and 2) leading to a porous, sponge-like injecting or evaporating element 102 which is in the path of the incoming air stream and which preferably lies upstream from the nozzle 92. In the event that water is produced in the filter 60 at a faster rate than can be disposed of by the porous element 102, it drains off harmlessly through a drain line 103. The porous element 102, by reason of its saturation with water, acts upon the relatively dry incoming (ambient) air to raise its humidity near the saturation level, following which the droplets 93 sprayed by the nozzle 92 create the condition of super-saturation, loading the air stream with droplets which are kept in suspension by the motion and turbulence of the stream. The elements 102, 92 together thus serve as the injecting means.

Not only does the intentional addition of water to the level of super-saturation at the compressor inlet bring about a higher coefficient of performance of the system as a whole, but the cooling capacity in BTU per hour (BTUH) is dramatically increased. A unit having a nominal capacity of 30,000 BTUH may, for example, have its capacity increased to 50,000 BTUH, simply by making use of the thermal capacity and latent heat of water as the auxiliary refrigerant.

Operation takes place automatically, but to control the rate at which water is fed to the compressor inlet from the sump 86, it will be apparent to one skilled in the art that the nozzle 92 may be equipped with an adjustable needle 105 (FIG. 3), or a throttling valve may be interposed in the line 91. Similarly, the line 100 which leads to the porous element 102 may have an interposed valve adjustable to low rates of flow.

Figure 3:
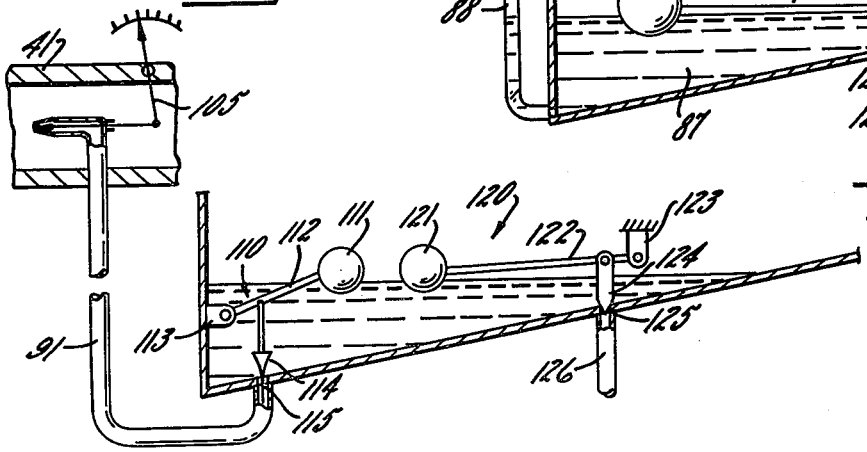

To insure that liquid water at all times exists in the first feedback line 91, that is, to prevent short circuiting of air through the line in the event the liquid 87 in the sump should fall to a low level, a control valve assembly 110 may be used as shown diagrammatically in FIG. 3. The valve assembly includes a float 111 mounted upon a generally horizontal arm 112 pivoted at 113 and controlling a tapered valve plunger 114 cooperating with a seat 115. By reason of the valve assembly the line 91 is automatically shut off upon loss of liquid from the sump, and, by tapering the valve plunger, the flow may be automatically proportioned in accordance with the height of the liquid available in the sump. Moreover, to make it unnecessary to manipulate drain valve 94 manually when the liquid in the sump rises to an excessive level, an overflow valve assembly 120 may be provided having a float 121 on a generally horizontal arm 122 pivoted at 123 and controlling a plunger 124. The plunger cooperates with a valve seat 125 leading to an overflow or drain line 126. As long as the liquid in the sump remains at a safe level, the valve plunger remains closed. However, should the liquid exceed the predetermined level, the plunger opens just long enough to drop the level back to the point where the valve will reclose. The plunger 124 may be in the form of a reciprocating needle-like element of small diameter so that the action of the float is not substantially affected by the differential pressure existing on the two sides of the valve seat 125. As an alternative to valve 114, a "pneumatic fuse" 127 having a ball 128 and spring 129 may be inserted into the line 91 to close the line in absence of liquid.

Figure 4:
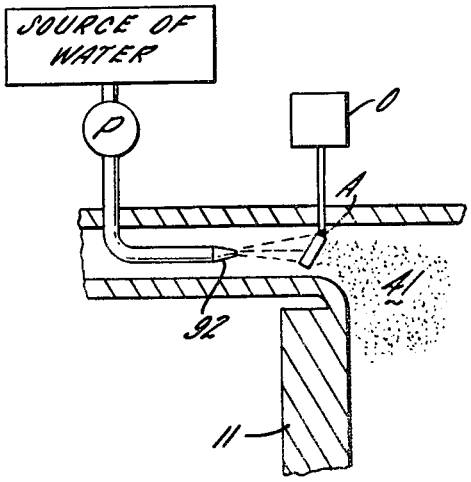
FIG. 4 shows alternative means for spraying into the compressor inlet port an excess of finely divided droplets and which may be utilized in absence of the recirculation feature.
Figure 12:
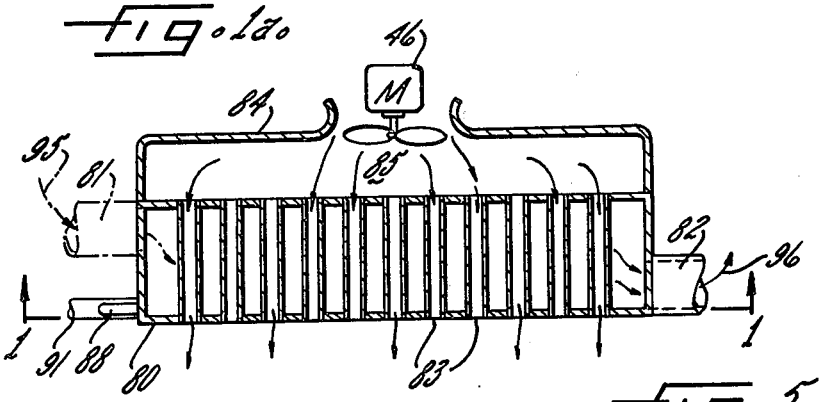

While recycling of the moisture, as above, is preferred, the invention is not limited thereto and a separate source of pressurized water may be used as shown in FIG. 4, the pressure being raised to the atomizing level by a pump P or equivalent, and with the nozzle 92 being adjusted according to the criteria discussed in connection with FIG. 3. For the purpose of making the droplet size as small as possible, say on the order of 1 to 1000 microns, so that the droplets present a large total area available for evaporation, the nozzle 92 (FIG. 4) may be of special "atomizing" design operated at high pressure, or a lower pressure may be used, with the nozzle-produced droplets subdivided by an atomizing device such as an impeller rotated at high speed or a piezo-electric element (indicated at A) driven by an oscillator O at sonic or ultrasonic frequency. Where an auxiliary source of water is relied upon, the water collecting in the heat exchanger may be disposed of by a simple overflow valve as shown in FIG. 5.

Note that in the system disclosed in FIGS. 1 and 2 the tempered air which is discharged into the controlled space via the vents 51, 52 is of relatively low humidity, comfortably dry, notwithstanding the fact that moisture has been added to the air at the compressor inlet to the point of gross super-saturation. However, the invention is not limited to the production of a cool mix of relatively dry air, but the invention is applicable, as well, to controlled spaces having a high humidity requirement. A high level of moisture may be added to the air stream by forming a controllable vent or bypass in the side of the moisture separator element 60. It is, indeed, one of the features of the present system that it may be used for intentionally loading the air in a cooled space with moisture as for example in the transport and storage of perishable fruits and vegetables. This can be done in the system of FIG. 1 by simply omitting the porous "separator" or filter 60 so that the ice and condensed water particles, instead of being intercepted, are simply blown by the cold air into the incoming stream of ambient air from the cooled space which serves to melt the ice particles in transit. The proportion of ambient air to cold air may be predetermined by selecting the rating and speed of the blower or fan assembly 55, 56. Moreover, fresh outside air may be incorporated in adjustable ratio in any of the systems disclosed herein by using a proportioning valve for the "space" air and "outside" air at inlet 54. If desired the cooled air and entrained ice may be discharged into the refrigerated space directly from the discharge outlet 44 without any pre-mixing with ambient air.

Alternatively, and to increase the moisture in the cold air stream, the water collected an condensed in the heat exchanger may be re-injected into the air passing through the expander. Referring to FIG. 6, in which the primed numerals correspond to FIG. 1, the condensed water, collected in sump 86', is injected by aspirating it in a carburetor type venturi 130 having a dip tube 131. The moisture is injected at the venturi in the form of droplets which keep their identity as they pass through the expander, and even increase in size by reason of condensation, turning into ice particles as the temperature and pressure drop. A similar result may be achieved without the aspirating venturi by simply elevating the heat exchanger so that condensate is deposited in the expander inlet port 43' by gravity and broken up by the passing vanes. Thus the term aspirating should be broadly construed to include this possibility. Where maximum moisture is required the cold, ice-laden air may, as stated, be simply dumped into the refrigerated space as indicated by the arrow. Or the air may be conducted, by a conduit 62' to a filter 60', where the ice is melted and where the water recovered therefrom may be recirculated to the nozzle 92' via a line 100'. The result in either event is to enable the heat exchanger to operate in the sealed state.

One advantage of discharging the water collected in the heat exchanger by aspiration or the like in the expander is that the air is artificially humidified, which is of advantage in regions which are characteristically hot and dry. In accordance with one of the aspects of the invention, the moisture which is collected in the heat exchanger may, instead, be conducted to the expander outlet port under pressure and, at the expander outlet port, may be sprayed into the discharged air. This is done as shown in FIG. 7 where elements previously referred to have been given doubly primed reference numerals. As shown in this figure a line 133 leads from the sump 86' to a nozzle 134 in the outlet port 44''. The water is broken up into small droplets at the nozzle 134 because of the pressure existing in the heat exchanger. The rate at which water is discharged from the nozzle 134 may be controlled by interposing a throttle valve 135 in the line 133.

The invention has been described above in connection with an "open" system in which the gas which is processed by the compressor-expander is air and in which the additive fluid is water. However, the invention is not limited thereto and is applicable, with certain additional advantages, to a "closed" system in which the second heat exchanger, similarly to the first heat exchanger, is directly interconnected between the expander outlet port and the compressor inlet as shown, for example, in FIG. 8. In this figure corresponding reference numerals have been used, where applicable, with addition of subscript *a*. The two systems, open and closed, are similar in most respects. Indeed, the main difference is that the system of FIG. 8 being closed, may be permanently charged with an additive fluid so that there is no necessity for drainage or feeding make-up in liquid form. The distributor may consist of two parts, a ring of sponge 102*a* or other porous material in capillary engagement with a pool of additive 104*a*. A needle valve 105*a* may be used to control the nozzle 92*a* for the same purpose as before, that is, to maximize the fluid undergoing change of state while keeping the amount of unconverted droplets to a reasonable level.

The similarities in operation between the two versions is best brought out by assuming that the system is charged with a mixture of air and water prior to being sealed, with excess water in the sump 86*a* and pool 104*a*. Thus as the rotor 20*a* rotates, air is drawn into the inlet 41*a* past the water-saturated sponge 102*a* and nozzle 92*a*. The air-water mix trapped between adjacent vanes is progressively compressed and passes through the outlet 42*a* into the first heat exchanger 45*a* where the mix is cooled to near ambient temperature and where most of the water is condensed. The air, still in saturated condition, flows into the expander side and is expanded in the compartments defined by the vanes, with a drop in temperature accompanied by condensation of the moisture in the form of ice particles. The air stream with its entrained ice passes into the second heat exchanger 50*a* which is located in the cooled space and which is coupled to the space by the illustrated fins and forced air fan 55*a*. Internal baffles 61*a* may be used in the heat exchanger to intercept the ice particles, or cold droplets, and to facilitate heat transfer. The baffles have drain holes 61*b* to permit drainage of the water down the conduit 71*a* and into the reservoir. If desired, the entire conduit may be lined with the porous material.

Since the motor 56*a* which drives the fan consumes an amount of power which is comparable to the motor 56 which drives the blower in the earlier embodiment, it will be understood that from the standpoint of power requirements, the two systems are much the same. The main advantage of the second or "closed" system is that it permits use of a wider variety of gases and additives, since neither the gas nor additive is discharged into the open air and, moreover, the system may be charged with lubricant soluble in, or miscible in, the additive fluid to provide constant lubrication of the vanes 21*a*–30*a*. For example, the same emulsified lubricant may be used as in machine tool practice. Thus any gas may be used which is non-condensing at the temperatures and pressures encountered during the course of the cycle, and any additive fluid may be used having a high heat of vaporization (preferably approaching that of water) and which is capable of rapid evaporation in the compressor and condensation in the heat exchanger and expander. If air is employed as the gas, the additive fluid may, for example, be in the form of alcohol or a hydrocarbon such as benzine, both of which are capable of undergoing a change in state within practically-employed ranges of temperatures and pressures. Instead of using air, carbon dioxide may be used or, indeed, almost any other gas which is stable, non-corrosive, and non-condensing at the encountered temperatures and pressures. Any lubricant may be used which is soluble or miscible with the additive, for example, common lubricating oil in dissolved or miscible state. Or, it desired, an additive may be employed which has inherent lubricating properties, in addition to its evaporative and condensing properties. It will be apparent to one skilled in the art that practice of the invention is not limited to use of a common or existing substance as an additive. Much work has already been done on the synthesizing of new fluorohydrocarbon compounds for the purpose of achieving predetermined change of state characteristics. In the case of the present device, used in a closed system, it may be desirable, by way of example, to have an additive which evaporates within the range of 100° to 200°F. over a pressure range of 14 to 50 pounds per square inch and which will condense in the range of 100° to 0°F. within the same pressure range. It is, of course, preferable to be able to choose an existing commercial substance having these properties but, as an alternative, the additive fluid may be synthesized, either as a single substance or as a combination of two substances, each individually suited to function either during compression or expansion. The synthesizing procedure is outside of the scope of the present invention.

The term "ambient" is a general one including air in the enclosed space, fresh outside air, or a mixture of the two. The term "vanes" as used herein will be understood to broadly include any partition means defining enclosed chambers which are progressively compressed in size, and enlarged, for the positive compressor and expander functions. The term "second heat exchanger" as used herein refers to any means, located at the outlet port of the expander, which brings about a heat transfer between the air in the space to be cooled and the air which flows from the outlet port. In the case of the "closed" system this heat exchanger is, of course, that which is indicated at 50*a*. In the case of the "open" system the mixing chamber 53 and the porous moisture separator 60 together with the means for inducing flow of air therethough, bring about a heat exchanging function and thus satisfy the term "heat exchanger". Any heat exchange means, even that occurring on direct discharge with ambient air, suffices.

Also while it is preferred to use a compressor-expander unit which employs a rotor cooperating with a stator of oval cross section to form compressor and expander portions, it is understood that the invention is not necessarily limited thereto and that the invention may be practiced, if desired, employing a separate vane type compressor and a vane type expander, each with appropriate inlet and outlet ports. Indeed, any device having a common shaft with means for first positively compressing and then positively expanding a gas may be employed in making use of the invention.

The term "air conditioning" will be understood to be synonymous with "refrigeration". Nevertheless, while the above described system is intended primarily for cooling purposes, it will be understood that it may be also employed as a heat pump by mounting the first heat exchanger 45*a* in the controlled space and a second heat exchanger 50*a* in the outside ambient; thus the term "air conditioning" is intended to cover heating as well as cooling.

The invention as described above is intended to operate with continuously sprayed water so that the benefits of high cooling capacity and high coefficient of performance may be obtained on a continuous basis. However, the invention may be utilized in compressor-expanders intended to operate normally in a "dry" state to provide urgent cooling and humidification on start-up. Referring to FIG. 9, in which corresponding elements are indicated by corresponding reference numerals with addition of subscript *b*, a compressor-expander 10*b* is shown intended for normal operation with dry air and having a simple form of heat exchanger 45*b* to produce discharge of cold air at outlet port 44*b*. In the inlet port 41*a* is a nozzle 42*b* having provision for receiving a "shot" of water from a manually operated injector 140. The injector includes a cylinder 141 and piston 142 having an operating handle 143 and a strong return spring 144.

Upon pulling the handle 143, water is drawn from a reservoir 145 through a first check valve 146. A second check valve 147 prevents sucking of air reversely through the nozzle during the "fill" portion of the cycle when the handle 143 is pulled.

When the cylinder 141 has a full charge of water which, in a practical case, may be on the order of two or three ounces, the handle 143 is released and the return spring 144 drives the water past the second check valve 147 where it is sprayed, in droplet form, by the nozzle 92*b* into the air stream.

In a practical case this results in an immediate near-doubling of the cooling capacity from, say, 30,000 BTUH to 50–60,000 BTUH resulting in an immediate and dramatic drop in temperature in an automobile which may have been standing in the sun and whose temperature may have risen to 120°F. or more. The nozzle 92*b*, plunger 142, and force of the spring 144 may, in a practical case, be so proportioned as to spread the discharge of water over an interval of, say, one-quarter to one-half minute. For convenience the operating handle 143 may be mounted to extend through the automobile dashboard. Because of the check valves operation is automatic and all that is required is a simple pull and release of the operating handle following which the force of the spring 144 takes over. The water reservoir 145 may be mounted under the hood similarly to the reservoir for the windshield wiper.

When operated in a dry climate, for example, in the southwestern part of the United States, the humidification which accompanies the instant temperature drop is equally appreciated. In such regions a dumping valve 148, open to the interior of the automobile, and directly associated with the outlet port 44*b* may be provided, the dumping valve being preferably coupled to the operating handle 143 by a suitable mechanical connection 150, the valve closing automatically when the operating handle 143 returns to normal position. In more humid climates the resulting particles of water and ice may be intercepted by filter 60 (FIG. 1) and the resulting liquid drained away. The arrangement thus permits use of a simple and inexpensive form of compressor-expander having no special provision for water but with the advantages of the present invention fully available on start-up. Preferably in this type of installation the heat exchanger 45*b* is positioned to drain automatically, by gravity, into the expander inlet port 43*b*.

I claim:

1. In an air conditioning system, an air conditioning unit including a compressor and an expander having rotor means driven by a common shaft, the rotor means having vanes defining enclosed compartments which become smaller and larger as the shaft rotates, the compressor and expander each having an inlet port and an outlet port, a first heat exchanger connected between the compressor outlet port and the expander inlet port, a second heat exchanger coupled to the expander outlet port, the heat exchangers being isolated from one another, means for conducting to the compressor inlet port a gas which is non-condensing at the temperatures and pressures encountered in the unit so that upon driving of the rotor means the gas (1) is positively compressed and heated in the compressor, (2) releases heat in the first heat exchanger, (3) is positively expanded and cooled in the expander, and (4) absorbs heat in the second heat exchanger, an additive fluid in the gas in the form of a fluid having a high heat of vaporization capable of evaporation in the compressor and condensation in the expander, and means for injecting droplets of the additive fluid into the gas entering the compressor inlet port at a sufficient rate to super-saturate the gas for evaporation of the fluid by the heat of compression with the change of state partially counteracting the heating of the compressed gas and consequently reducing the work required to compress it, with at least a portion of the evaporated fluid being condensed in the first heat exchanger, the gas flowing into the expander being at least substantially saturated with the additive fluid resulting in condensation in the expander to form particles with the change of state partially counteracting the cooling of the expanding gas resulting in an increase in the work of expansion thereby further reducing the work required to drive the rotor, and means for disposing of the additive fluid condensed in the first heat exchanger.

2. The combination as claimed in claim 1 in which means are provided for intercepting the condensed particles in the second heat exchanger to increase the heat exchange.

3. The combination as claimed in claim 1 in which the drop in temperature in the expander is sufficiently great that the condensed particles are in the frozen state with means being provided in the second heat exchanger for intercepting and liquifying the particles thereby to increase the heat exchange.

4. The combination as claimed in claim 1 in which means are provided in the second heat exchanger for intercepting the condensed particles and for converting them to liquid form, and means for feeding the resulting liquid to the injecting means.

5. The combination as claimed in claim 1 including means in the second heat exchanger for trapping particles of additive fluid received from the expander and for collecting the fluid in liquid form, means in the first heat exchanger for collecting additive fluid condensed therein in liquid form, and means including feedback conduits for conducting the fluid in liquid form from the heat exchangers to the injecting means for recirculation thereof.

6. The combination as claimed in claim 5 in which means are provided for connecting the outlet of the second heat exchanger to the compressor inlet port to seal the unit so that both the gas and the additive fluid in the gas are conserved for continuous recirculation.

7. The combination as claimed in claim 5 in which the injecting means includes a porous distributing element and a nozzle at the compressor inlet port with means for feeding additive fluid from the second heat exchanger to the porous element and for feeding condensate from the first heat exchanger to the nozzle.

8. The combination as claimed in claim 7 in which the porous element is positioned slightly upstream of the nozzle.

9. In an air conditioning system, an air conditioning unit including a compressor and an expander having rotor means driven by a common shaft, the rotor means having vanes defining enclosed compartments which become smaller and larger as the shaft rotates, the compressor and expander each having an inlet port and an outlet port, a first heat exchanger connecting between the compressor outlet port and the expander inlet port, a second heat exchanger coupled to the expander outlet port, the heat exchangers being isolated from one another, means for conducting to the compressor inlet port a gas which is non-condensing at temperatures and pressures encountered in the unit so that upon driving of the rotor means the gas (1) is positively compressed and heated in the compressor, (2) releases heat in the first heat exchanger, (3) is positively expanded and cooled in the expander, and (4) absorbs heat in the second heat exchanger, an additive fluid in the gas, the additive fluid being one having a high heat of vaporization capable of undergoing change in state from liquid to vapor form in the compressor to reduce work of compression and from vapor to non-vapor form in the expander for increasing the work of expansion, and means for spraying finely divided droplets of additive fluid into the gas entering the compressor inlet port to the point of super-saturation.

10. In an air conditioning system, an air conditioning unit including a compressor and an expander having rotor means driven by a common shaft, the rotor means having vanes defining enclosed compartments which become smaller and larger as the shaft rotates, the compressor and expander each having an inlet port and an outlet port, a first heat exchanger connecting between the compressor outlet port and the expander inlet port, a second heat exchanger coupled to the expander outlet port, the heat exchangers being isolated from one another, means for conducting to the compressor inlet port a gas which is non-condensing at temperatures and pressures encountered in the unit so that upon driving of the rotor means the gas (1) is positively compressed and heated in the compressor, (2) releases heat in the first heat exchanger, (3) is positively expanded and cooled in the expander, and (4) absorbs heat in the second heat exchanger, an additive fluid in the gas, the additive fluid being one having a high heat of vaporization capable of undergoing (*a*) vaporization from liquid to vapor form in the compressor to reduce work of compression and (*b*) condensation from vapor to liquid form in the first heat exchanger, a sump in the first heat exchanger, means for spraying finely divided droplets of additive fluid into the gas entering the compressor inlet port to the point of super-saturation, and means defining a feedback conduit connected from the sump to the spraying means for conducting condensed liquid under pressure to the spraying means.

11. In an air conditioning system, an air conditioning unit including a compressor and an expander having rotor means driven by a common shaft, the rotor means having vanes defining enclosed compartments which become smaller and larger as the shaft rotates, the compressor and expander each having an inlet port and an outlet port, a first heat exchanger connected between the compressor outlet port and the expander inlet port, a second heat exchanger coupled to the expander outlet port, the heat exchangers being isolated from one another, means for conducting to the compressor inlet port a gas which is non-condensing at temperatures and pressures encountered in the unit so that upon driving of the rotor means the gas (1) is positively compressed and heated in the compressor, (2) releases heat in the first heat exchanger, (3) is positively expanded and cooled in the expander, and (4) absorbs heat in the second heat exchanger, an additive fluid in the gas, the additive fluid being one having a high heat of vaporization capable of undergoing change in state from liquid to vapor form in the compressor to reduce work of compression and from vapor to non-vapor form in the expander for increasing the work of expansion, means for spraying finely divided droplets of additive fluid into the gas entering the compressor inlet port to super-saturate the same, the droplets being sprayed at a rate which causes at least some of them to be discharged in droplet form into the first heat exchanger, thereby to insure that a maximum amount of fluid undergoes a change of state in the compressor, and means for disposing of additive fluid collected and condensed in the first heat exchanger.

12. In an air conditioning system, an air conditioning unit including a compressor and an expander having rotor means driven by a common drive shaft, the rotor means having vanes defining enclosed compartments which become smaller and larger as the shaft rotates, the compressor and expander each having an inlet port and an outlet port, a heat exchanger connected between the compressor outlet port and the expander inlet port, means for conducting air to the compressor inlet port so that upon rotation of the drive shaft the air (1) is positively compressed and elevated in temperature in the compressor, (2) releases heat in the heat exchanger, and (3) is positively expanded and lowered in temperature in the expander for discharge in the cold state, means for injecting finely divided water droplets into the air stream at the compressor inlet port so that liquid moisture is available in the compressor for evaporation by the heat of compression thereby to partially counteract the increase in temperature and pressure of the compressed air and consequently to reduce the work required to compress it, the water droplets being introduced at a sufficient rate to supersaturate the inlet air so that condensation of at least a portion of the evaporated moisture occurs in the heat exchanger and means for at least periodically disposing of water condensed in the heat exchanger.

13. In an air conditioning system, an air conditioning unit including a compressor and an expander having rotor means driven by a common drive shaft, the rotor means having vanes defining enclosed compartments which become smaller and larger as the shaft rotates, the compressor and expander each having an inlet port and an outlet port, a heat exchanger connected between the compressor outlet port and the expander inlet port, means for conducting air to the compressor inlet port so that upon rotation of the drive shaft the air (1) is positively compressed and elevated in temperature in the compressor, (2) releases heat in the heat exchanger, and (3) is positively expanded and lowered in temperature in the expander for discharge in the cold state, means for injecting finely divided water droplets into the air stream at the compressor inlet port so that liquid moisture is available in the compressor for evaporation by the heat of compression thereby to partially counteract the increase in temperature and pressure of the compressed air and consequently to reduce the work required to compress it, the water droplets being introduced at a sufficient rate to supersaturate the inlet air so that condensation of at least a portion of the evaporated moisture occurs in the heat exchanger, a sump in the heat exchanger for collecting the condensed moisture plus any unevaporated droplets of water, and means for removing the accumulated water from the sump.

14. The combination as claimed in claim 13 in which means are provided in the injecting means for controlling the rate of injection to a level which will insure change of state of a maximum amount of water to vapor form in the compressor while limiting the discharge of water in droplet form from the compressor to the heat exchanger.

15. In an air conditioning system, an air conditioning unit including a compressor and an expander having rotor means driven by a common drive shaft, the rotor means having vanes defining enclosed compartments which become smaller and larger as the shaft rotates, the compressor and expander each having an inlet port and an outlet port, a heat exchanger connected between the compressor outlet port and the expander inlet port, means for conducting air to the compressor inlet port so that upon rotation of the drive shaft the air (1) is positively compressed and elevated in temperature in the compressor, (2) releases heat in the heat exchanger, and (3) is positively expanded and lowered in temperature in the expander for discharge in the cold state, means for injecting finely divided water droplets into the air stream at the compressor inlet port so that liquid moisture is available in the compressor for evaporation by the heat of compression thereby to partially counteract the increase in temperature and pressure of the compressed air and consequently to reduce the work required to compress it, the water droplets being introduced at a sufficient rate to supersaturate the inlet air so that condensation of at least a portion of the evaporated moisture occurs in the heat exchanger, and means for aspirating the condensed water from the heat exchanger into the air stream flowing from the heat exchanger to the expander for disposing of the same.

16. The combination as claimed in claim 12 in which a substantial number of the finely divided droplets have a dimension at least as small as 1 to 1000 microns.

17. In an air conditioning system, an air conditioning unit including a compressor and an expander having rotor means driven by a common drive shaft, the rotor means having vanes defining enclosed compartments which become smaller and larger as the shaft rotates, the compressor and expander each having an inlet port and an outlet port, a heat exchanger connected between the compressor outlet port and the expander inlet port, means for cnducting air to the compressor inlet port so that upon rotation of the drive shaft the air (1) is positively compressed and elevated in temperature in the compressor, (2) releases heat in the heat exchanger, and (3) is positively expanded and lowered in temperature in the expander for discharge in the cold state, means including a nozzle for injecting finely divided water droplets into the air stream at the compressor inlet port so that liquid moisture is available in the compressor for evaporation by the heat of compression thereby to partially counteract the increase in temperature and pressure of the compressed air and consequently to reduce the work required to compress it, the water droplets being introduced at a sufficient rate to super-saturate the inlet air so that condensation of at least a portion of the evaporated moisture occurs in the heat exchanger, and means for at least periodically disposing of water condensed in the heat exchanger, the heat exchanger having a sump for collecting the condensed moisture plus any unevaporated droplets of water, and a feedback line for interconnecting the sump with the nozzle for recirculation of the water, the water being transported from the sump and through the nozzle by reason of the pressure differential between the heat exchanger and the compressor inlet port.

18. The combination as claimed in claim 17 for insuring that only water flows through the feedback line free of flow of air between the heat exchanger and the compressor inlet port.

19. The combination as claimed in claim 17 in which an auxiliary source of water is provided at the compressor inlet port including means for automatic feeding for replenishment of the water in the sump to insure presence of liquid water in the feedback line and for avoidance of blow-by of air between the heat exchanger and the compressor inlet port.

20. The combination as claimed in claim 13 in which the means for removing water includes a drain line in the sump and level-responsive means for discharging excess liquid through the drain line:

21. The combination as claimed in claim 13 in which the heat exchanger includes means for trapping water droplets remaining in the air stream after compression of the air in the compressor so that the air which flows into thee expander side includes dissolved moisture substantially free of droplets of liquid moisture.

22. The combination as claimed in claim 21 in which the means for trapping the water droplets includes surfaces in the heat exchanger causing abrupt change in direction of the air stream.

23. In an air conditioning system, the combination comprising a compressor-expander including a compressor and an expander having rotor means driven by a common drive shaft, the rotor means having vanes defining enclosed compartments which become smaller and larger as the shaft rotates, the compressor and expander each having an inlet port and an outlet port, a heat exchanger connected between the compressor outlet port and the expander inlet port, means for conducting air to the compressor inlet port so that upon rotation of the drive shaft the air (1) is positively compressed and elevated in temperature in the compressor, (2) releases heat in the heat exchanger, and (3) is positively expanded and lowered in temperature in the expander for discharge in the cold state, means for injecting finely divided water droplets into the air stream at the compressor inlet port so that moisture is available in the compressor for evaporation by the heat of compression thereby to partially counteract the increase in the temperature of the compressed air and consequently the work required to compress it, the water droplets being introduced at a sufficient rate to super-saturate the inlet air so that condensation of at least a portion of the evaporated moisture occurs in the heat exchanger and so that the air fed to the expander is substantially saturated with moisture for condensation in the expander, a sump in the heat exchanger for collecting the condensed moisture plus any unevaporated droplets, means including a feedback line connecting the sump to the injecting means for recirculation of the water, means including a filter for recovering the condensed moisture from the air leaving the expander and means including a second feedback line connecting the filter to the injecting means for supplementing the recirculated water thereby to insure continuity of a supply of water in the sump.

24. The combination as claimed in claim 9 in which the spraying means includes a nozzle and in which power operated atomizing means are provided for acting upon the droplets produced by the nozzle for dividing each of them into smaller size.

25. The combination as claimed in claim 24 in which a substantial number of the atomized droplets have a dimension at least as small as 1 to 1000 microns.

26. In an air conditioning system for an automobile or the like, an air conditioning unit including a compressor and expander intended for normal operation in the dry state and having rotor means driven by a common shaft, the rotor means having vanes defining enclosed compartments which become smaller and larger as the shaft rotates, the compressor and expander each having an inlet port and an outlet port, a heat exchanger connected between the compressor outlet port and the expander inlet port, an inlet conduit for conducting ambient air to the compressor inlet port so that upon driving of the rotor means the gas (1) is positively compressed and elevated in temperature in the compressor, (2) releases heat in the heat exchanger, (3) is positively expanded and lowered in temperature in the expander for discharge in the cold state, a reservoir of water, means for dispensing a measured shot of water from the source into the conduit over a brief interval of time in such form that the water is entrained by the air in the conduit and carried into the compressor for grossly super-saturating the inlet air, with the moisture being subsequently cooled and condensed in the heat exchanger, the heat exchanger being so arranged that the moisture in liquid form therein along with the moisture in the vapor state flows into the expander for discharge from the latter at low temperature thereby to bring about a temporary increase in the cooling capacity of the unit, and manually operated means for triggering the dispensing means.

27. The combination as claimed in claim 26 in which the dispensing means includes a chamber for holding a measured quantity of water on the order of a few ounces and having a restricted discharge nozzle in the conduit together with means for applying pressure to empty the chamber, the pressure being so related to the restriction in the nozzle as to discharge the water in a period substantially less than a minute.

28. The combination as claimed in claim 26 in which the dispensing means is in the form of a cylinder having a manually pulled piston and in which the pressure-applying means is in the form of a return spring for the piston, the return spring being sufficiently strong so that the nozzle discharges the shot of water in the form of droplets.

29. The combination as claimed in claim 26 in which a dumping valve is provided at the expander outlet port for dumping of expanded air and the lower temperature particles of moisture into the cooled space, and means operated automatically incident to cycling of the dispensing means for temporarily opening the valve.

30. In an air conditioning system, an air conditioning unit including a compressor and an expander having rotor means driven by a common drive shaft, the rotor means having vanes defining enclosed compartments which become smaller and larger as the shaft rotates, the compressor and expander each having an inlet port and an outlet port, a heat exchanger connected between the compressor outlet port and the expander inlet port, means for conducting air to the compressor inlet port so that upon rotation of the drive shaft the air (1) is positively compressed and elevated in temperature in the compressor, (2) releases heat while under pressure in the heat exchanger, and (3) is positively expanded and lowered in temperature in the expander for discharge in the cold state, means including a first nozzle for injecting finely divided water droplets into the air stream at the compressor inlet port so that liquid moisture is available in the compressor for evaporation by the heat of compression thereby to partially counteract the increase in temperature and pressure of the compressed air and consequently to reduce the work required to compress it, the water droplets being introduced at a sufficient rate to super-saturate the inlet air so that condensation of at least a portion of the evaporated moisture occurs in the heat exchanger, means including a second nozzle for injecting finely divided water droplets into the air stream at the expander outlet port, and means for conducting water condensed in the heat exchanger under pressure from the heat exchanger to at least one of the nozzles.

* * * * *